US005518247A

United States Patent [19]

Robichaud

[11] Patent Number: 5,518,247

[45] Date of Patent: May 21, 1996

[54] NEW AGE PYRAMID GAME

[76] Inventor: Dennis J. Robichaud, R.R. 1 Box 48AB, Sutton, Vt. 05867

[21] Appl. No.: 316,226

[22] Filed: Sep. 30, 1994

[51] Int. Cl.[6] ..... A63F 3/00

[52] U.S. Cl. ..... 273/236; 273/161

[58] Field of Search ..... 273/161, 236

[56] References Cited

U.S. PATENT DOCUMENTS

| | | | |
|---|---|---|---|
| 3,306,617 | 2/1967 | Gillespie | 273/161 |
| 3,797,832 | 3/1974 | Benwell | 273/161 |
| 4,261,572 | 4/1981 | Breinholt | 273/161 |

OTHER PUBLICATIONS

"One Answer to Cheap Wine and Lost Lust", *The Washington Star,* Jul. 31, 1977 pp. C1 and C8.

"Swinging on a Thread", *The Washington Post,* Apr. 13, 1977, p. B14.

*Primary Examiner*—William E. Stoll

[57] ABSTRACT

A pyramid game with a glass pyramid portion having a top portion, an open bottom, an inner surface, and an outer surface. A hook piece is secured to the inner surface of the top portion. A base portion is hingedly secured to the open bottom of the glass pyramid portion. The base portion has a game board integral therewith. The game board includes a plurality of letters and numbers thereon. Included in the invention is a crystal piece having a clamp secured to a portion thereof. The clamp has a chain thereattached. The chain is removably coupled with the hook piece of the glass pyramid portion. The crystal piece serves for pointing to the game board as it moves under forces of anyone of a plurality of types.

3 Claims, 3 Drawing Sheets

FIG 1
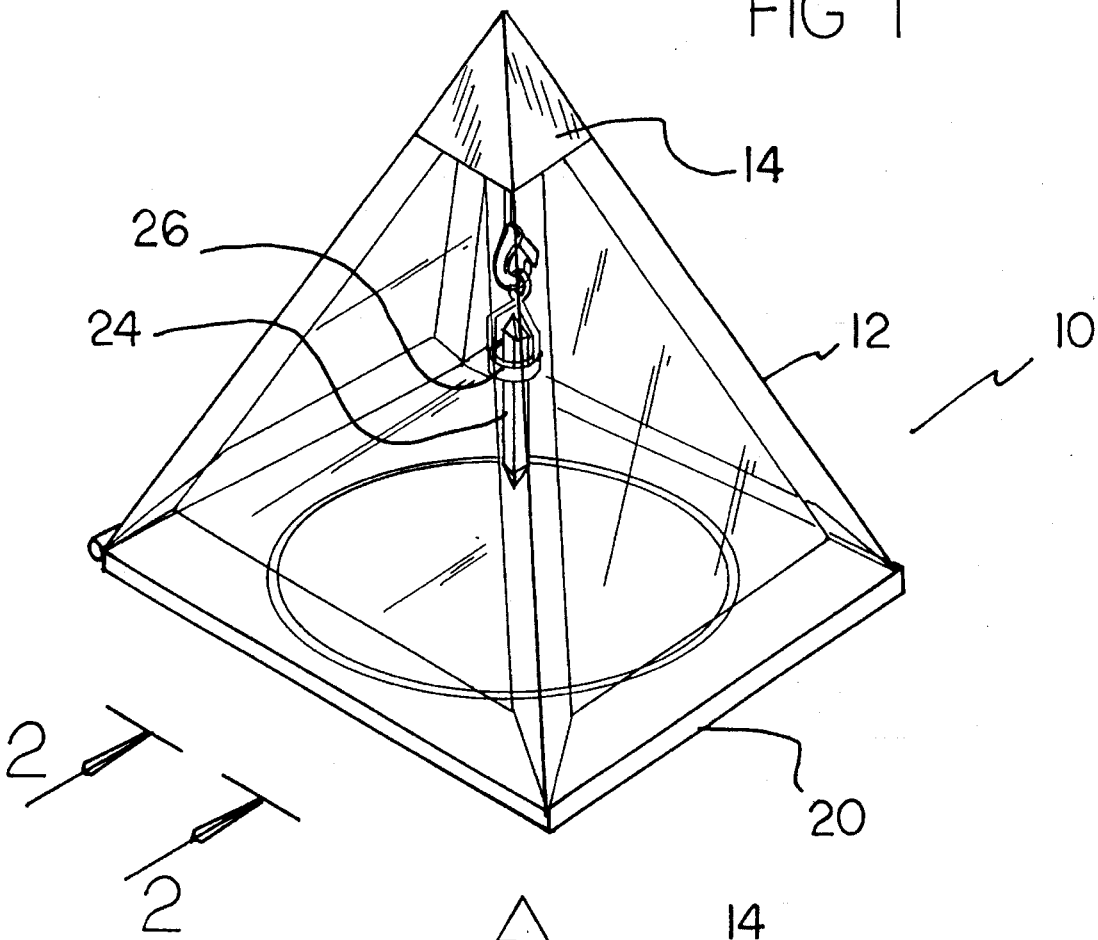
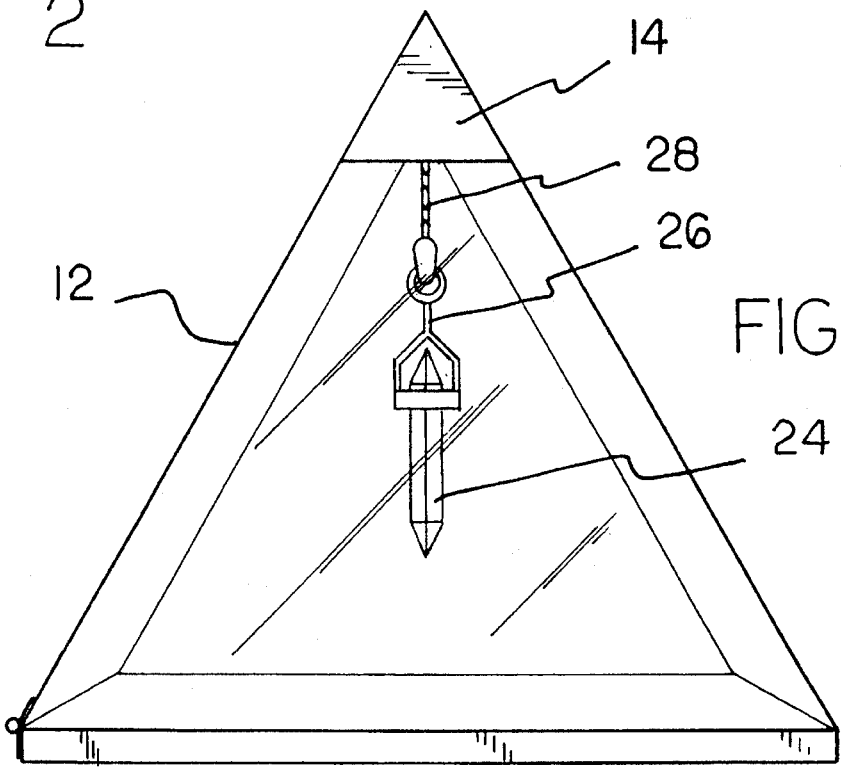
FIG 2

FIG 5
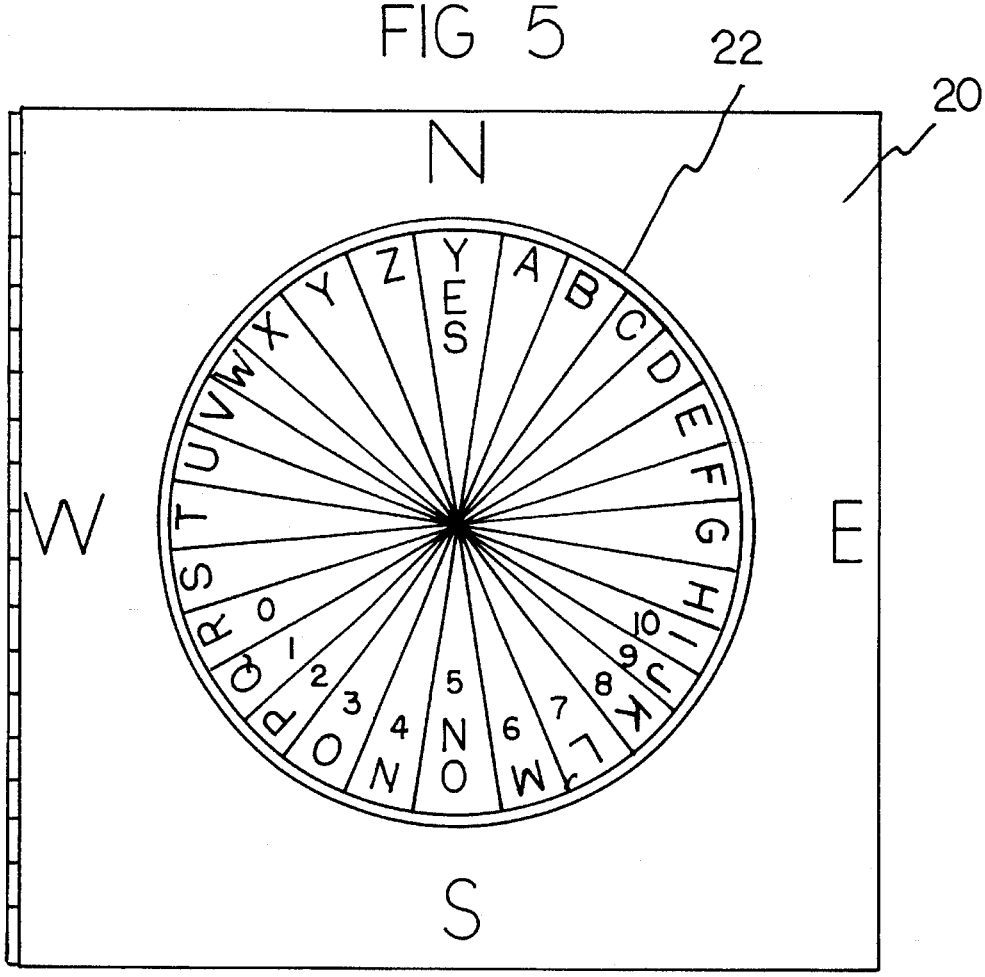
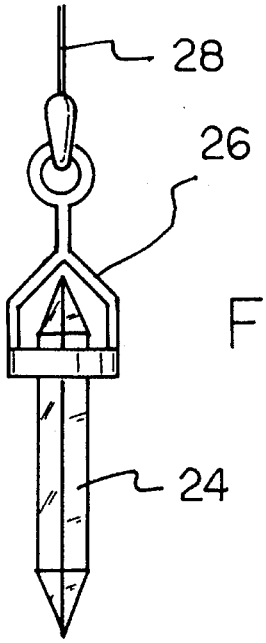
FIG 6

NEW AGE PYRAMID GAME

BACKGROUND OF THE INVENTION

1. Field of the Invention

The present invention relates to a new age pyramid game and more particularly pertains to providing an E.S.P. game with a new age pyramid game.

2. Description of the Prior Art

The use of pyramid games is known in the prior art. More specifically, pyramid games heretofore devised and utilized for the purpose of providing games that tell the future are known to consist basically of familiar, expected and obvious structural configurations, notwithstanding the myriad of designs encompassed by the crowded prior art which have been developed for the fulfillment of countless objectives and requirements.

By way of example, U.S. Pat. No. Des. 328,475 to Gould et al. discloses the ornamental design for a pyramid game.

U.S. Pat. No. 4,261,572 to Breinholt discloses a pyramidal fortune-telling game.

U.S. Pat. No. 4,162,073 to Norris discloses a hollow pyramid containing indicia-bearing spheres.

U.S. Pat. No. 4,014,551 to Alfonso discloses a fortune-telling game.

U.S. Pat. No. 3,746,345 to Palazzolo discloses a pyramid type amusement and educational device.

While these devices fulfill their respective, particular objective and requirements, the aforementioned patents do not describe a new age pyramid game for providing an E.S.P. game.

In this respect, the new age pyramid game according to the present invention substantially departs from the conventional concepts and designs of the prior art, and in doing so provides an apparatus primarily developed for the purpose of providing an E.S.P. game.

Therefore, it can be appreciated that there exists a continuing need for new and improved new age pyramid game which can be used for providing an E.S.P. game. In this regard, the present invention substantially fulfills this need.

SUMMARY OF THE INVENTION

In the view of the foregoing disadvantages inherent in the known types of pyramid games now present in the prior art, the present invention provides an improved new age pyramid game. As such, the general purpose of the present invention, which will be described subsequently in greater detail, is to provide a new and improved new age pyramid game and method which has all the advantages of the prior art and none of the disadvantages.

To attain this, the present invention essentially comprises a glass pyramid portion having a top portion, an open bottom, an inner surface, and an outer surface. A hook piece is secured to the inner surface of the top portion. The device contains a base portion having an upper surface and a lower surface. The base portion is hingedly secured to the open bottom of the glass pyramid portion. The upper surface has a game board integral therewith. The game board includes the numbers 0 thru 10, every letter of the alphabet, and the words "yes" and "no". The game board has a square configuration including four sides. One of the four sides has an "E" printed thereon. Another of the sides has an "S" thereon. Another of the sides has a "W" thereon. Another of the sides has an "N" thereon. The device contains a crystal piece having a clamp secured to a portion thereof. The clamp has a chain thereattached. The chain is removably coupled with the hook piece of the glass pyramid portion. The crystal piece serves as a means of pointing to the game board.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved new age pyramid game which has all the advantages of the prior art pyramid games and none of the disadvantages.

It is another object of the present invention to provide a new and improved new age pyramid game which may be easily and efficiently manufactured and marketed.

It is a further object of the present invention to provide a new and improved new age pyramid game which is of durable and reliable construction.

An even further object of the present invention is to provide a new and improved new age pyramid game which is susceptible of a low cost of manufacture with regard to both materials and labor, and which accordingly is then susceptible of low prices of sale to the consuming public, thereby making such a new age pyramid game economically available to the buying public.

Still yet another object of the present invention is to provide a new and improved new age pyramid game which provides in the apparatuses and methods of the prior art some of the advantages thereof, while simultaneously overcoming some of the disadvantages normally associated therewith.

Even still another object of the present invention is to provide a new and improved new age pyramid game for providing an E.S.P. game.

Lastly, it is an object of the present invention to provide a new and improved new age pyramid game with a glass pyramid portion having a top portion, an open bottom, an inner surface, and an outer surface. A hook piece is secured to the inner surface of the top portion. A base portion is hingedly secured to the open bottom of the glass pyramid portion. The base portion has a game board integral therewith. The game board includes a plurality of letters and numbers thereon. Included in the invention is a crystal piece having a clamp secured to a portion thereof. The clamp has a chain thereattached. The chain is removably coupled with the hook piece of the glass pyramid portion. The crystal piece serves as a means of pointing to the game board.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the new age pyramid game constructed in accordance with the principles of the present invention.

FIG. 2 is a side elevational view of the present invention.

FIG. 5 is a cross-sectional view of the game board taken along line 6—6 of FIG. 5.

FIG. 6 is an enlarged front view of the crystal of the present invention.

The same reference numerals refer to the same parts through the various Figures.

DESCRIPTION OF THE PREFERRED EMBODIMENT

Figure 3:
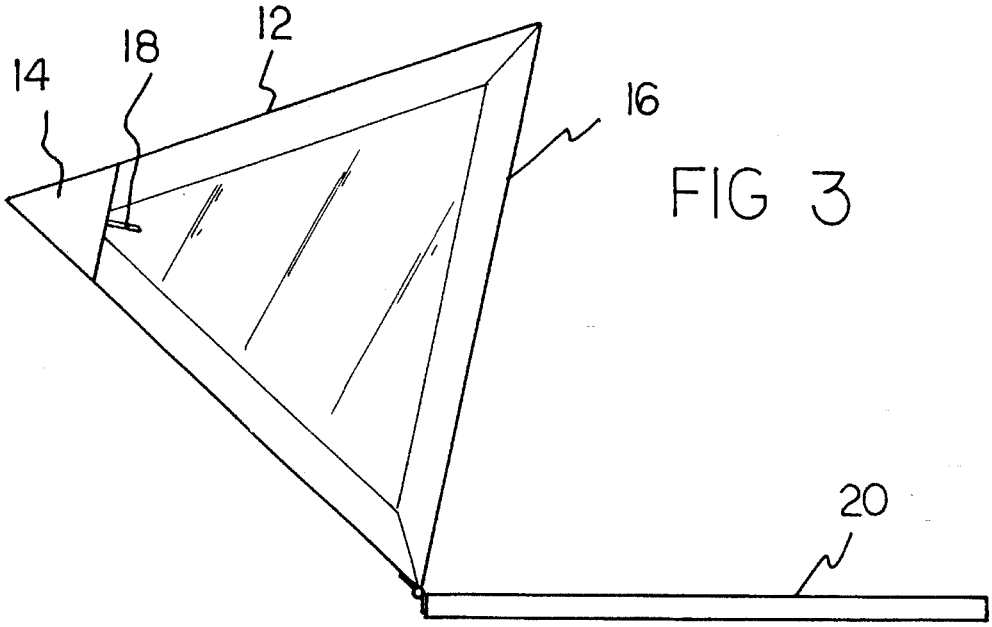
FIG. 3 is a side elevational view of the present invention illustrating the hinged top portion.
Figure 4:
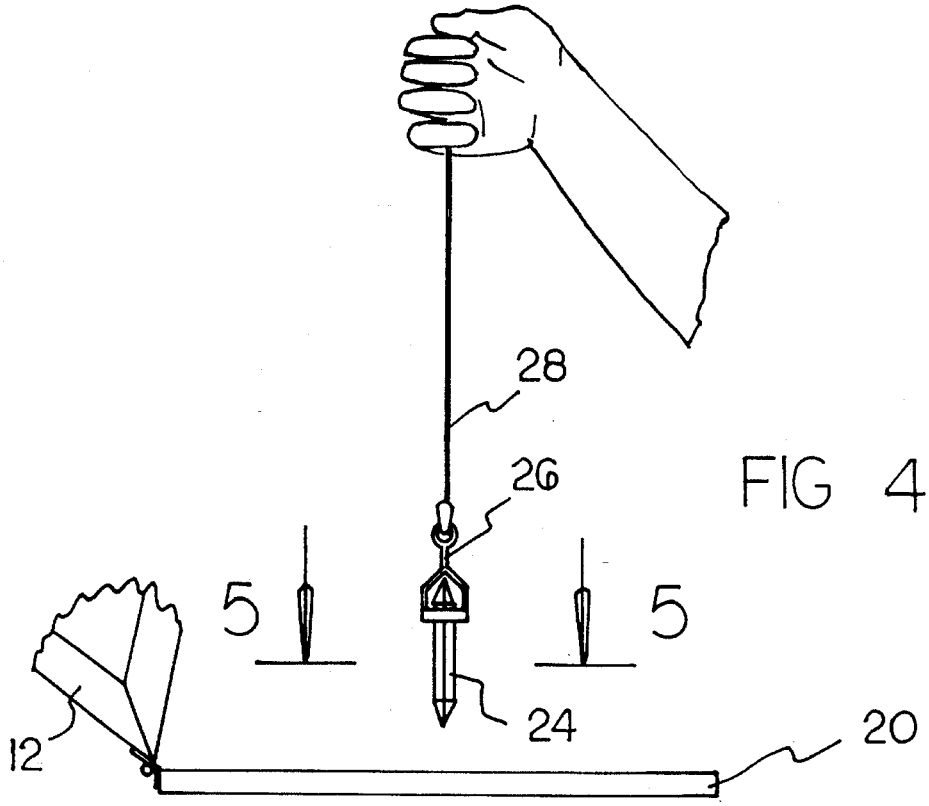
FIG. 4 is a front elevational view of the crystal piece of the present invention.

With reference now to the drawings, and in particular, to FIG. 1 thereof, the preferred embodiment of the new and improved new age pyramid game embodying the principles and concepts of the present invention and generally designated by the reference number 10 will be described.

Specifically, it will be noted in the various Figures that the device relates to a new and improved new age pyramid game for providing an E.S.P. game. In its broadest context, the device consists of a glass pyramid portion, a base portion, and a crystal piece.

The device 10 contains a glass pyramid portion 12 having a top portion 14, an open bottom 16, an inner surface, and an outer surface. A hook piece 18 is secured to the inner surface of the top portion 14.

The device 10 contains a base portion 20 having an upper surface and a lower surface. The base portion 20 is hingedly secured to the open bottom 16 of the glass pyramid portion 12. The upper surface has a game board 22 integral therewith. The game board 22 includes the numbers 0 thru 10, every letter of the alphabet, and the words "yes" and "no". The game board has a square configuration including four sides. One of the four sides has an "E" printed thereon. Another of the sides has an "S" thereon. Another of the sides has a "W" thereon. Another of the sides has an "N" thereon.

The device 10 contains a crystal piece 24 having a clamp 26 secured to a portion thereof. The clamp 26 has a chain 28 thereattached. The chain 28 is removably coupled with the hook piece 18 of the glass pyramid portion 12. The crystal piece 24 serves as a means of pointing to the game board 22.

RULES OF THE GAME:

Place your New Age Pyramid on a flat surface in front of you.

Carefully tip the glass pyramid on its side, revealing the game surface.

You will find your new age crystal inside, which is inside the New Age Pyramid. Place the new age crystal in the palm of your hand. Gently close your hand around the crystal. This will charge or ready your crystal for use.

Holding onto the end of the chain, let the crystal hang directly above the center point of the circle on the game surface. Try to keep the crystal as close as possible to the game surface without touching. You may wish to rest your elbow on your table or flat surface for comfort.

Now you are ready to begin. By asking the New Age Pyramid a question, upon which you will concentrate, the crystal will then begin to move in a swaying motion toward a letter, number or direction. This will pertain to your question.

Write down each letter, number or direction on a piece of paper. Hopefully, you will get results from your New Age Pyramid.

Note: Do not get discouraged if this does not work for you the first few times out. Sometimes choosing a different time of day or night to play may help. Relaxed and quiet surroundings are always helpful while playing.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A new age pyramid game comprising, in combination:

a glass pyramid portion having a top portion, an open bottom, an inner surface, and an outer surface, a hook piece secured to the inner surface of the top portion;

a base portion having an upper surface and a lower surface, the base portion hingedly secured to the open bottom of the glass pyramid portion, the upper surface having a game board integral therewith, the game board including the numbers 0 thru 10, every letter of the alphabet, and the words "yes" and "no", the game board having a square configuration including four sides, one of the four sides having an "E", printed thereon, another of the sides having an "S" thereon, another of the sides having a "W" thereon, another of the sides having an "N" thereon;

a crystal piece having a clamp secured to a portion thereof, the clamp having a chain theresecured, the chain removably coupled with the hook piece of the glass pyramid portion, the crystal piece serving as a means of pointing to the game board.

2. A pyramid game comprising, in combination:

a glass pyramid portion having a top portion, an open bottom, an inner surface, and an outer surface, a hook piece secured to the inner surface of the top portion;

a base portion hingedly secured to the open bottom of the glass pyramid portion, the base portion having a game board integral therewith, the game board including a plurality of letters and numbers thereon;

a crystal piece having a clamp secured to a portion thereof, the clamp having a chain theresecured, the chain removably coupled with the hook piece of the glass pyramid portion, the crystal piece serving as a means of pointing to the game board.

3. The game as described in claim 2 and further wherein the plurality of letters and numbers including the numbers 0 thru 10, every letter of the alphabet, and the words "yes" and "no", the game board having a square configuration including four sides, one of the four sides having an "E", printed thereon, another of the sides having an "S" thereon, another of the sides having a "W" thereon, another of the sides having an "N" thereon.

* * * * *